US007088044B2

(12) United States Patent
Yoo

(10) Patent No.: US 7,088,044 B2
(45) Date of Patent: Aug. 8, 2006

(54) PLASMA DISPLAY PANEL (PDP) HAVING ELECTROMAGNETIC WAVE SHIELDING ELECTRODES

(75) Inventor: Hun-Suk Yoo, Cheonan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/103,435

(22) Filed: Apr. 12, 2005

(65) Prior Publication Data

US 2005/0231109 A1 Oct. 20, 2005

(30) Foreign Application Priority Data

Apr. 20, 2004 (KR) ..... 10-2004-0027142

(51) Int. Cl.
*H01J 17/49* (2006.01)

(52) U.S. Cl. ..... 313/587; 313/582; 313/584; 313/586

(58) Field of Classification Search ..... 313/582–587; 315/169.4; 345/37, 41, 60, 71
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto et al. |
| RE37,444 | E | 11/2001 | Kanazawa |
| 6,630,916 | B1 | 10/2003 | Shinoda |

(Continued)

FOREIGN PATENT DOCUMENTS

JP 02-148645 6/1990

(Continued)

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

A PDP that can significantly improve light emitting efficiency and light transmission includes a new discharge cell structure and electromagnetic wave shielding electrodes that replace the function of an electromagnetic wave shielding filter includes: a transparent front substrate; a rear substrate arranged in parallel to the front substrate; a plurality of front barrier ribs, consisting of a dielectric material, and arranged between the front substrate and the rear substrate to define discharge cells together with the front substrate and the rear substrate; a front discharge electrode and a rear discharge electrode, separated from each other, and arranged in the front barrier rib to surround the discharge cell; at least one electromagnetic wave shielding electrode, arranged in front of and separated from the front discharge electrode, and surrounding the discharge cell; a plurality of rear barrier ribs arranged between the front barrier ribs and the rear substrate; a fluorescent layer arranged in a space defined by the rear barrier ribs; and a discharge gas arranged within the discharge cells.

12 Claims, 14 Drawing Sheets

U.S. PATENT DOCUMENTS

| | | | | |
|---|---|---|---|---|
| 6,707,436 | B1 | 3/2004 | Setoguchi et al. | |
| 2002/0017863 | A1* | 2/2002 | Kim et al. | 313/586 |
| 2002/0135545 | A1* | 9/2002 | Akiba | 345/60 |
| 2003/0184229 | A1* | 10/2003 | Kim et al. | 313/587 |
| 2004/0090170 | A1* | 5/2004 | Cha et al. | 313/489 |
| 2004/0214023 | A1* | 10/2004 | Park et al. | 428/458 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

FIG. 14
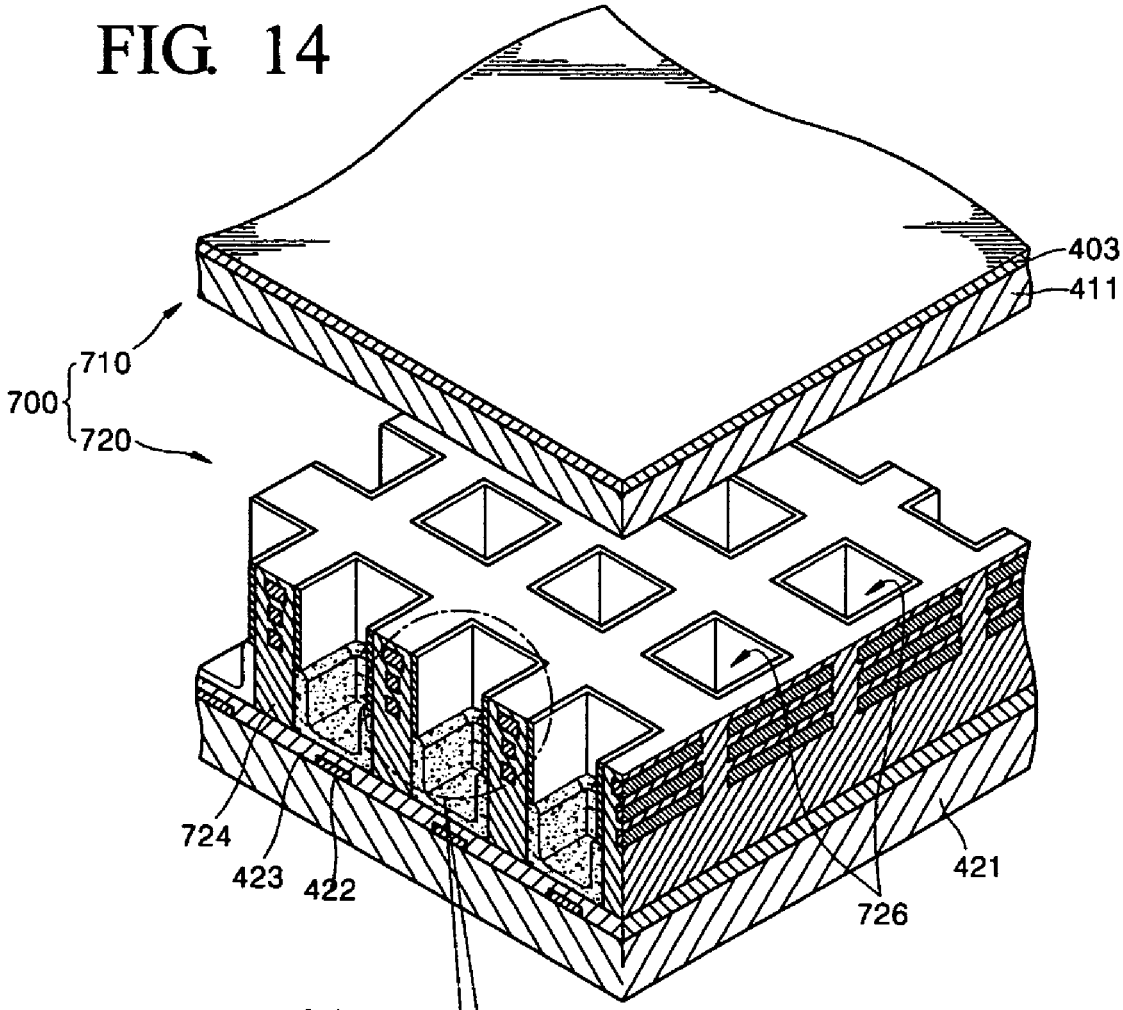
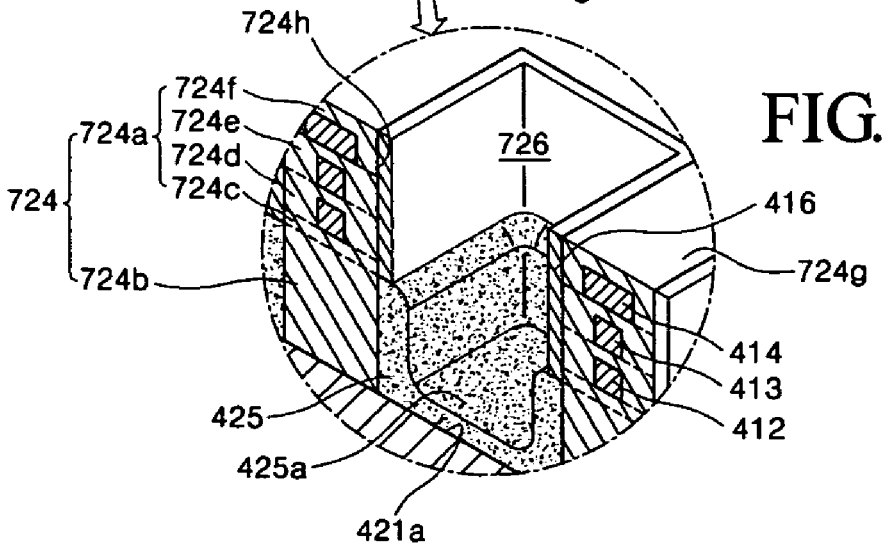
FIG. 14A

PLASMA DISPLAY PANEL (PDP) HAVING ELECTROMAGNETIC WAVE SHIELDING ELECTRODES

CLAIM OF PRIORITY

This application makes reference to, incorporates the same herein, and claims all benefits accruing under 35 U.S.C. §119 from an application for PLASMA DISPLAY PANEL HAVING ELECTROMAGNETIC WAVE SHIELDING ELECTRODES earlier filed in the Korean Intellectual Property Office on 20 Apr. 2004 and there duly assigned Serial No. 2004-27142.

BACKGROUND OF THE INVENTION

1. Field of the Invention

The present invention relates to a Plasma Display Panel (PDP), and more particularly, to a PDP having an electromagnetic wave shielding electrode.

2. Description of the Related Art

A PDP includes a front case having a peripheral unit to define a window, an electromagnetic wave shielding filter to cover the window, a conductive filter holder fixed to a coupling boss of the front case by a screw to press the electromagnetic wave shielding filter onto the front case, a PDP on the rear of the filter holder, including a front panel and a rear panel, a chassis to support the PDP, connecting cables mounted on the rear of the chassis, connecting the PDP to a driver to drive the PDP, and a rear case to couple with the front case to form a case to the rear of the chassis. A thermal conductive sheet is interposed between the PDP and the chassis.

In an alternative type three electrode surface discharge PDP, the front panel includes a front substrate, sustaining electrode pairs including Y electrodes and X electrodes formed on the rear surface of the front substrate, a front dielectric layer to cover the sustaining electrode pairs, and a protective film to cover the front dielectric layer. Each of the Y electrodes and the X electrodes includes transparent electrodes formed of ITO and bus electrodes formed of a high conductivity metal. The bus electrodes are connected to a connecting cable located on the left and right sides of the PDP.

The rear panel includes a rear substrate, address electrodes crossing the sustaining electrode pairs on the front surface of the rear substrate, a rear dielectric layer to cover the address electrodes, barrier ribs to define discharge cells formed on the rear dielectric layer, and a fluorescent layer in each of the discharge cells. The address electrodes are connected to connecting cables located in the upper and lower parts of the PDP.

The electromagnetic wave shielding filter includes a central unit facing the window, and a peripheral unit surrounding the central unit. A conductive mesh layer to shield electromagnetic waves is formed in the central unit, and a metal layer to electrically connect the conductive mesh layer to the conductive filter holder is formed in the peripheral unit. The conductive mesh layer is formed on a transparent substrate and covered by a planarized layer, and a near infrared shielding layer is formed on the planarized layer. Electromagnetic energy trapped by the conductive mesh layer is transferred to the rear of the PDP via the metal layer and the conductive filter holder or discharged to the outside of the PDP.

However, the above plasma display device has a low brightness problem due to the absorption of visible light emitted from the fluorescent layer in the discharge cells, by the sustaining electrode pairs that cause the discharge, the front dielectric layer, and the protective layer on the rear surface of the front substrate through which the light must pass, and the electromagnetic wave shielding filter that has low transmission of light in front of the rear panel.

Also, in the PDP, all of the sustaining electrode pairs except the bus electrodes have to be formed of ITO electrodes, which have a high resistance, to transmit the visible light generated by the discharge cells, since the sustaining electrode pairs that cause the discharge are located on the rear surface of the front substrate, thereby increasing driving voltage. Also, the voltage drop of the ITO electrodes can cause non-uniform images in a large panel.

Also, in the PDP, the discharge occurs at the rear of the protective film in the discharge cells, since the electrodes that cause the discharge are formed on the rear surface of the front substrate through which the visible light is transmitted. This causes a drop in light emitting efficiency. Also, there is a problem of a permanent latent image due to ion sputtering on the fluorescent layer by charged particles of the discharge gas.

Also, a plasma display device having above structure is expensive to manufacture, since the electromagnetic wave shielding filter and the filter holder must be manufactured separately and then attached to the front case.

Also, in a plasma display device having above structure, a space is formed between the electromagnetic wave shielding filter and the PDP due to the thickness of the conductive filter holder. Heat generated by the PDP builds up in this space, because air circulation is blocked by the conductive filter holder. Paths for ventilation can be formed by modifying the shape of the conductive filter holder, but since the gap (the thickness of the conductive filter holder) between the electromagnetic wave shielding filter and the PDP is very small, it is difficult to provide sufficient heat discharge by air circulation.

Also, the conductive mesh layer reduces light transmission and brightness ratio by absorbing or diffracting a portion of the visible light generated by the discharge cells, since the electromagnetic wave shielding filter in front of the PDP includes the conductive mesh layer.

Also, the contrast ratio of the PDP is lowered since the PDP does not include a device for absorbing external light. Accordingly, a clear image can not be displayed. To solve these problems, an additional device for absorbing the external light can be applied to the PDP, but this requires an additional process and cost.

SUMMARY OF THE INVENTION

The present invention provides a PDP that can solve the problems of non-uniform images, a permanent latent image, and lowering of the contrast ratio of the PDP, and can significantly improve discharge efficiency, opening ratio, transmission of light, and heat radiation efficiency.

According to an aspect of the present invention, a PDP is provided comprising: a transparent front substrate; a rear substrate arranged in parallel to the front substrate; a plurality of front barrier ribs, formed of a dielectric material, are arranged between the front substrate and the rear substrate to define discharge cells together with the front substrate and the rear substrate; a front discharge electrode and a rear discharge electrode, separated from each other, are arranged in the front barrier rib to surround the discharge cell; at least one electromagnetic wave shielding electrode, arranged in front of and separated from the front discharge electrode, and surrounding the discharge cell; a plurality of rear barrier ribs arranged between the front barrier ribs and the rear substrate; a fluorescent layer arranged in each space defined by the rear barrier ribs; and a discharge gas arranged within the discharge cells.

The at least one electromagnetic wave shielding electrode is preferably arranged in the front barrier ribs.

The at least one electromagnetic wave shielding electrode is preferably arranged on the rear of the front substrate and covered by the front barrier ribs.

The at least one electromagnetic wave shielding electrode is preferably of a dark color.

The at least one electromagnetic wave shielding electrode is preferably electrically connected to an external conductive member of the PDP.

The external conductive member preferably comprises a chassis adapted to support the PDP from the rear of the PDP.

The PDP preferably further comprises a near infrared ray shielding layer affixed to the front substrate.

The front discharge electrodes preferably extend in one direction and the rear discharge electrodes extend to cross the front discharge electrodes in the discharge cells.

The PDP further preferably comprises address electrodes, wherein the front discharge electrodes and the rear discharge electrodes extend in one direction and wherein the address electrodes extend to cross the front discharge electrodes and the rear discharge electrodes.

The address electrodes are preferably arranged between the rear substrate and the fluorescent layers, and a dielectric layer is preferably located between the address electrodes and the fluorescent layers.

The front discharge electrodes and the rear discharge electrodes each preferably have a ladder shape, and at least the side surface of the front barrier ribs is preferably covered by a protective film.

The front barrier ribs and the rear barrier ribs preferably comprise a single unit.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein:

FIGS. 14 and 14A together form a cutaway exploded perspective view of a PDP according to a third embodiment of the present invention.

DETAILED DESCRIPTION OF THE INVENTION

Figure 1:
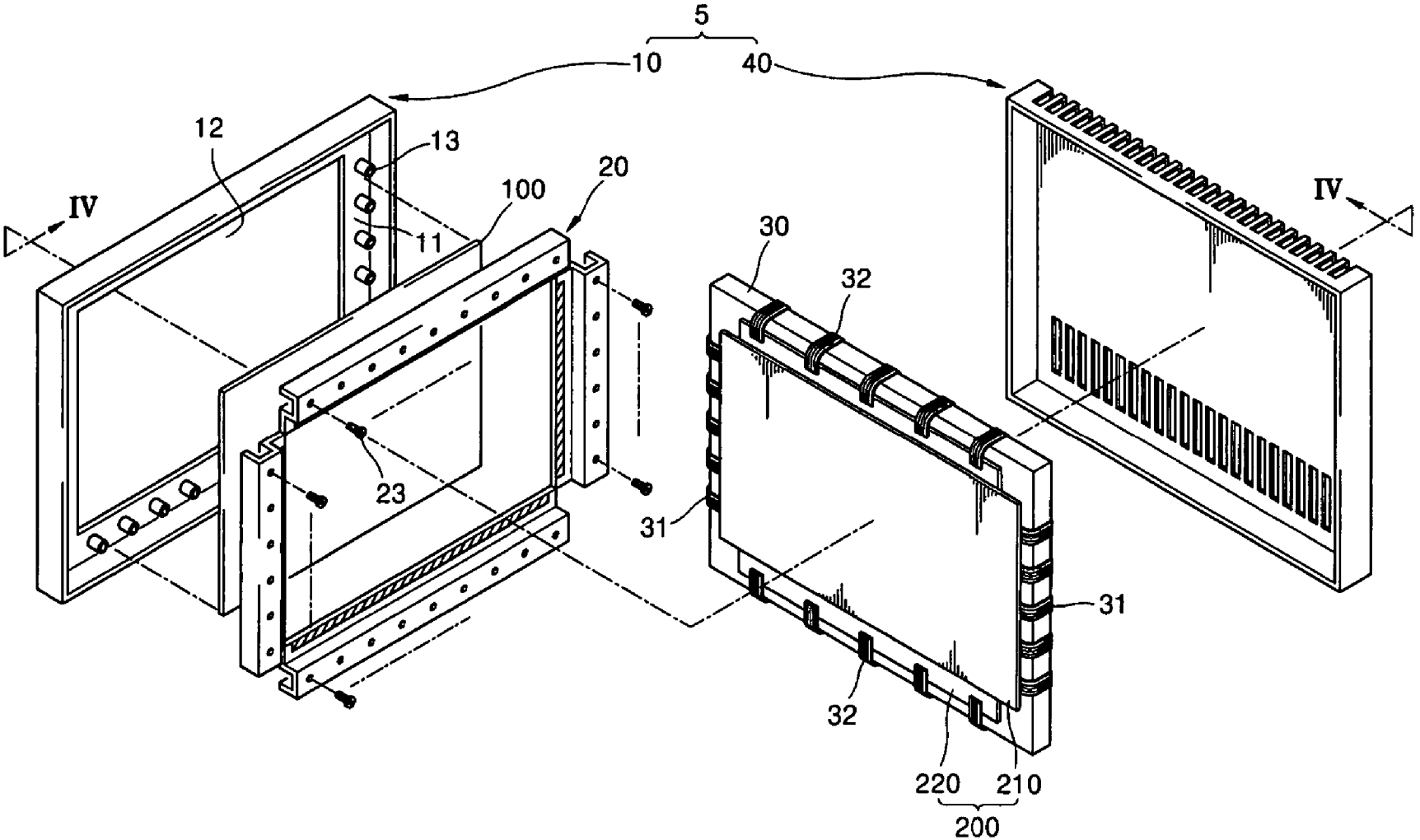
FIG. 1 is an exploded perspective view of a PDP.
Figure 4:
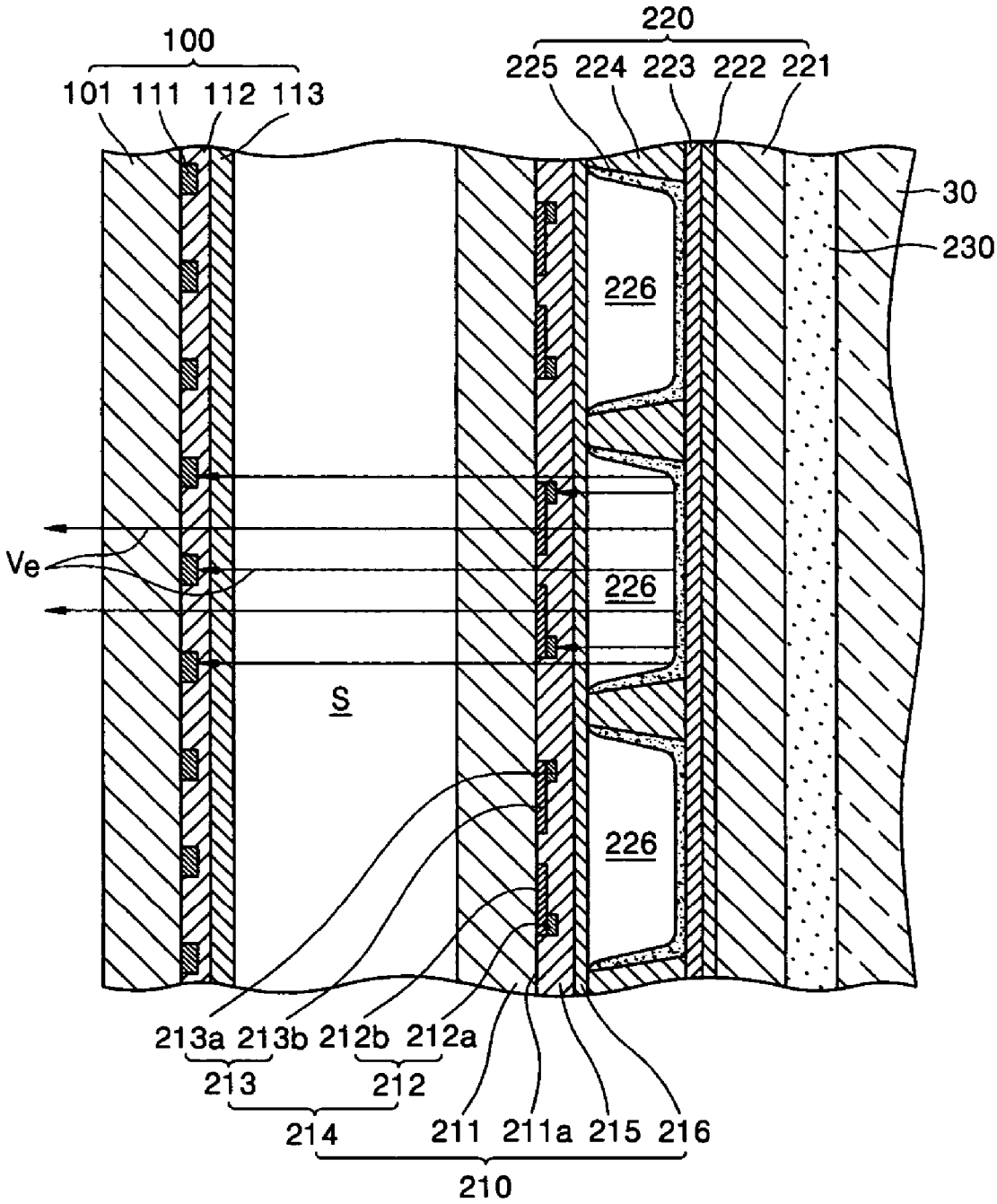
FIG. 4 is a cross-sectional view taken along line IV—IV of FIG. 1.

FIG. 1 is an exploded perspective view of a PDP. Referring to FIG. 1, the PDP includes a front case 10 having a peripheral unit 11 to define a window 12, an electromagnetic wave shielding filter 100 to cover the window 12, a conductive filter holder 20 fixed to a coupling boss 13 of the front case 10 by a screw 23 to press the electromagnetic wave shielding filter 100 onto the front case 10, a PDP 200 on the rear of the filter holder 20, including a front panel 210 and a rear panel 220, a chassis 30 to support the PDP 200, connecting cables 31 and 32 mounted on the rear of the chassis 30, connecting the PDP 200 to a driver (not shown) to drive the PDP 200, and a rear case 40 to couple with the front case 10 to form a case 5 to the rear of the chassis 30. As depicted in FIG. 4, a thermal conductive sheet 230 is interposed between the PDP 200 and the chassis 30.

Figure 2:
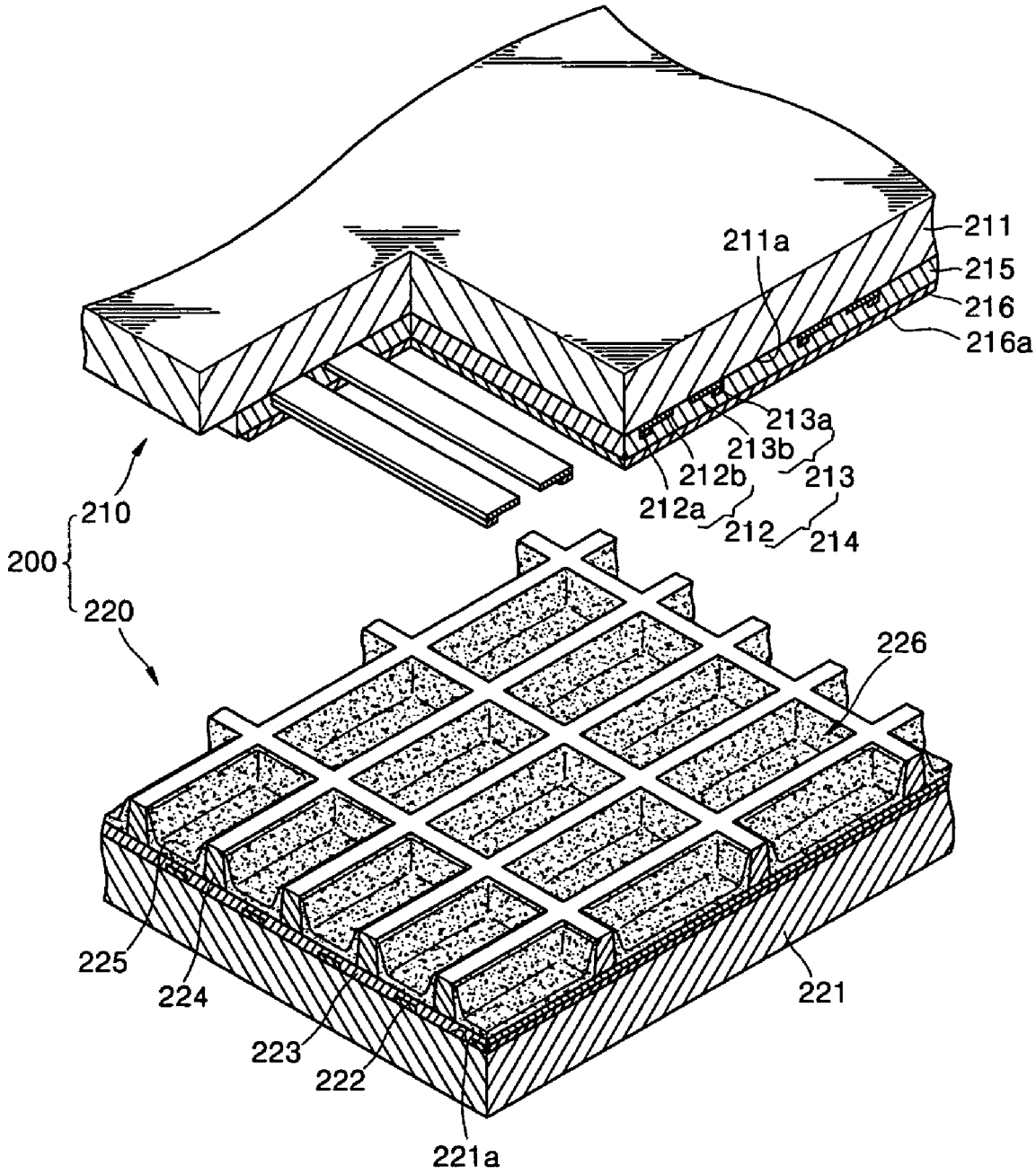
FIG. 2 is a cutaway perspective view of an alternative type three electrode surface discharge PDP.
Figure 12:
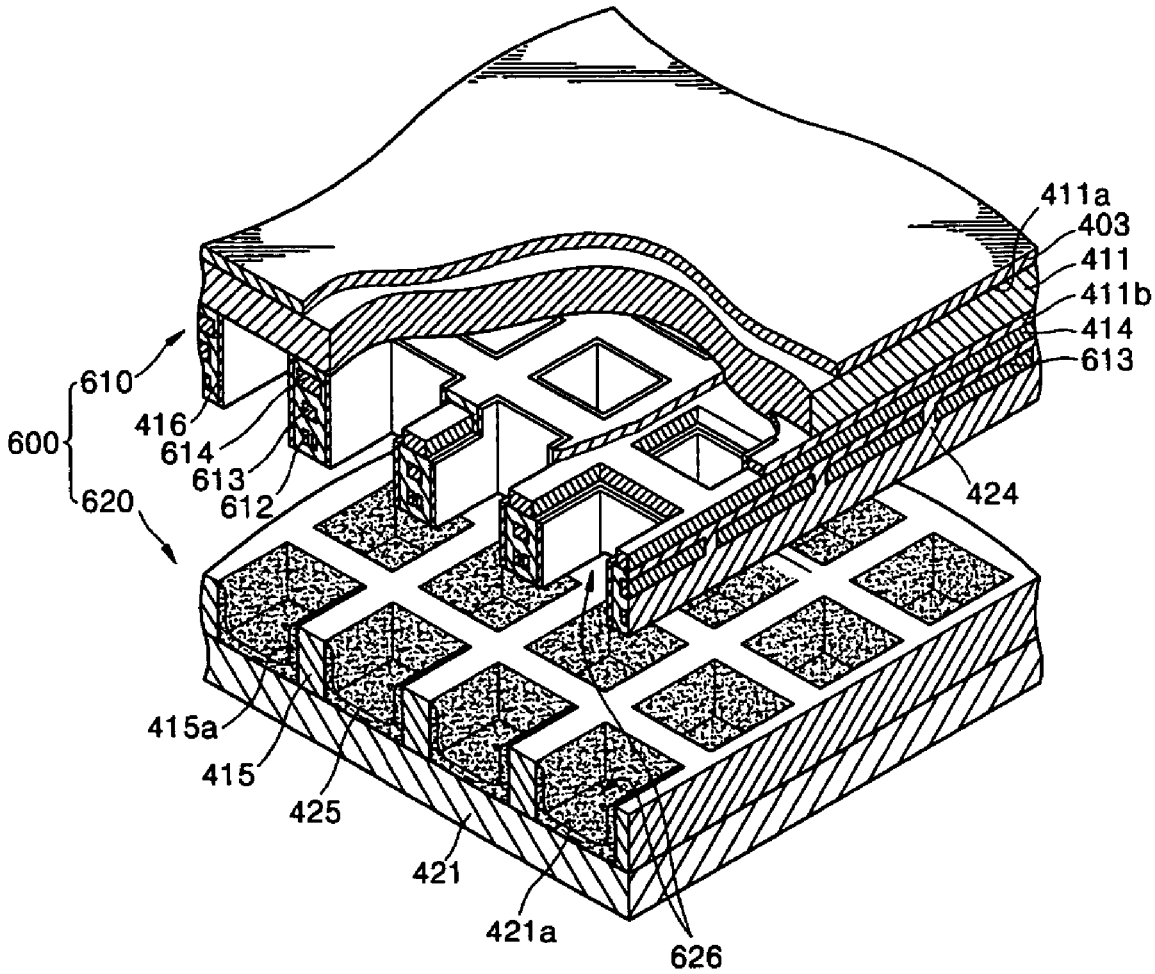
FIG. 12 is a cutaway exploded perspective view of a PDP according to a second embodiment of the present invention.

FIG. 2 is a cutaway exploded perspective view of part of an alternative type three electrode surface discharge PDP. Referring to FIG. 12, the front panel 210 and the rear panel 220 of the alternative type three electrode surface discharge PDP 200 is depicted. The front panel 210 includes a front substrate 211, sustaining electrode pairs 214 including Y electrodes 212 and X electrodes 213 formed on the rear surface 211*a* of the front substrate 211, a front dielectric layer 215 to cover the sustaining electrode pairs 214, and a protective film 216 to cover the front dielectric layer 215. Each of the Y electrodes 212 and the X electrodes 213 includes transparent electrodes 212*b* and 213*b* formed of ITO and bus electrodes 212*a* and 213*a* formed of a high conductivity metal. The bus electrodes 212*a* and 213*a* are connected to a connecting cable 31 located on the left and right sides of the PDP 200.

The rear panel 220 includes a rear substrate 221, address electrodes 222 crossing the sustaining electrode pairs 214 on the front surface 221*a* of the rear substrate 221, a rear dielectric layer 223 to cover the address electrodes 222, barrier ribs 224 to define discharge cells 226 formed on the rear dielectric layer 223, and a fluorescent layer 225 in each of the discharge cells. The address electrodes 222 are connected to connecting cables 32 located in the upper and lower parts of the PDP 200.

Figure 3:
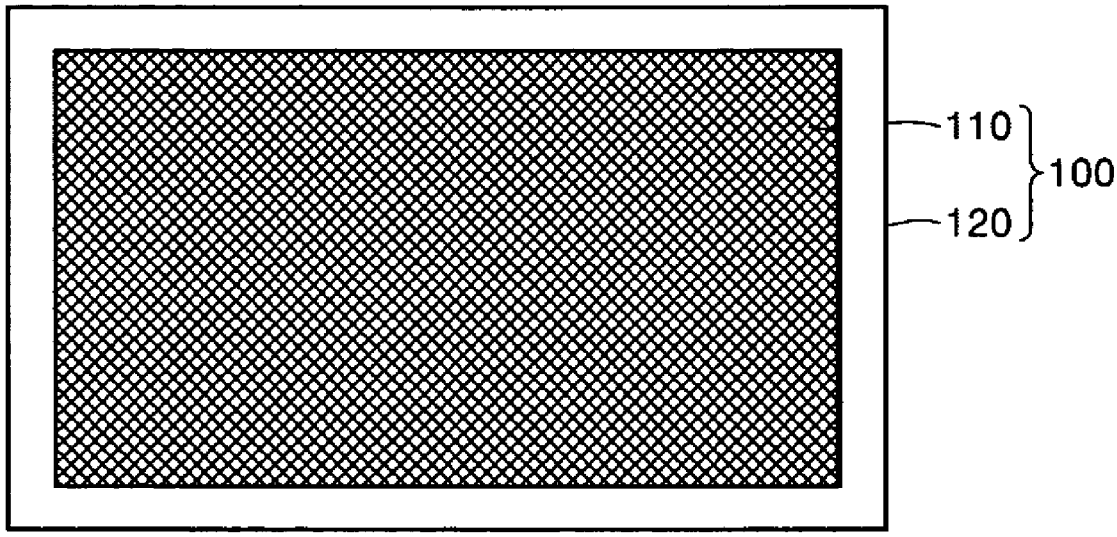
FIGS. 3 and 3A is a plan view and a magnified portion thereof of an electromagnetic wave shielding filter applied to a PDP.
Figure 3A:
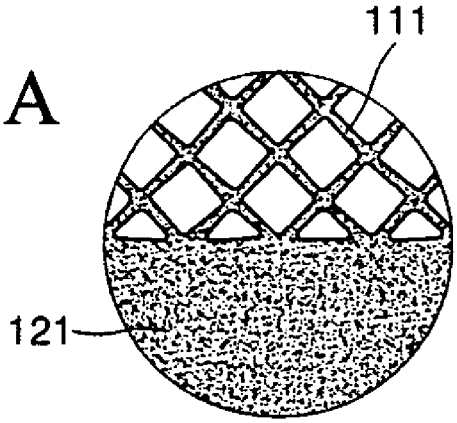

The electromagnetic wave shielding filter 100, as depicted in FIGS. 3 and 3A, includes a central unit 110 facing the window 12, and a peripheral unit 120 surrounding the central unit 110. A conductive mesh layer 111 to shield electromagnetic waves is formed in the central unit 110, and a metal layer 121 to electrically connect the conductive mesh layer 111 to the conductive filter holder 20 is formed in the peripheral unit 120. As depicted in FIG. 4, the conductive mesh layer 111 is formed on a transparent substrate 113 and covered by a planarized layer 112, and a near infrared shielding layer 101 is formed on the planarized layer 112. Electromagnetic energy trapped by the conductive mesh layer 111 is transferred to the rear of the PDP 200 via the metal layer 121 and the conductive filter holder 20 or discharged to the outside of the PDP 200.

However, the above plasma display device, as depicted in FIG. 4, has a low brightness problem due to the absorption of visible light emitted from the fluorescent layer 225 in the discharge cells 226, by the sustaining electrode pairs 214 that cause the discharge, the front dielectric layer 215, and the protective layer 216 on the rear surface 211*a* of the front substrate 211 through which the light must pass, and the electromagnetic wave shielding filter 100 that has low transmission of light in front of the rear panel 220.

Also, in the PDP 200, all of the sustaining electrode pairs 214 except the bus electrodes have to be formed of ITO electrodes, which have a high resistance, to transmit the visible light generated by the discharge cells 226, since the sustaining electrode pairs 214 that cause the discharge are located on the rear surface 211*a* of the front substrate 211, thereby increasing driving voltage. Also, the voltage drop of the ITO electrodes can cause non-uniform images in a large panel.

Also, in the PDP 200, the discharge occurs at the rear of the protective film 216 in the discharge cells 226, since the electrodes that cause the discharge are formed on the rear surface 211*a* of the front substrate 211 through which the visible light is transmitted. This causes a drop in light emitting efficiency. Also, there is a problem of a permanent latent image due to ion sputtering on the fluorescent layer by charged particles of the discharge gas.

Also, a plasma display device having above structure is expensive to manufacture, since the electromagnetic wave shielding filter 100 and the filter holder 20 must be manufactured separately and then attached to the front case 10.

Also, in a plasma display device having above structure, a space S is formed between the electromagnetic wave shielding filter 100 and the PDP 200 due to the thickness of the conductive filter holder 20. Heat generated by the PDP 200 builds up in this space S, because air circulation is blocked by the conductive filter holder 20. Paths for ventilation can be formed by modifying the shape of the conductive filter holder 20, but since the gap (the thickness of the conductive filter holder 20) between the electromagnetic wave shielding filter 100 and the PDP 200 is very small, it is difficult to provide sufficient heat discharge by air circulation.

Also, the conductive mesh layer 111 reduces light transmission and brightness ratio by absorbing or diffracting a portion of the visible light generated by the discharge cells, since the electromagnetic wave shielding filter 100 in front of the PDP 200 includes the conductive mesh layer 111.

Also, the contrast ratio of the PDP 200 is lowered since the PDP 200 does not include a device for absorbing external light. Accordingly, a clear image can not be displayed. To solve these problems, an additional device for absorbing the external light can be applied to the PDP, but this requires an additional process and cost.

The present invention will now be described more fully with reference to the accompanying drawings in which exemplary embodiments of the invention are shown.

A plasma display panel (PDP) according to a first embodiment of the present invention will now be described in detail with reference to the FIGS. 5 through 8.

Figure 5:
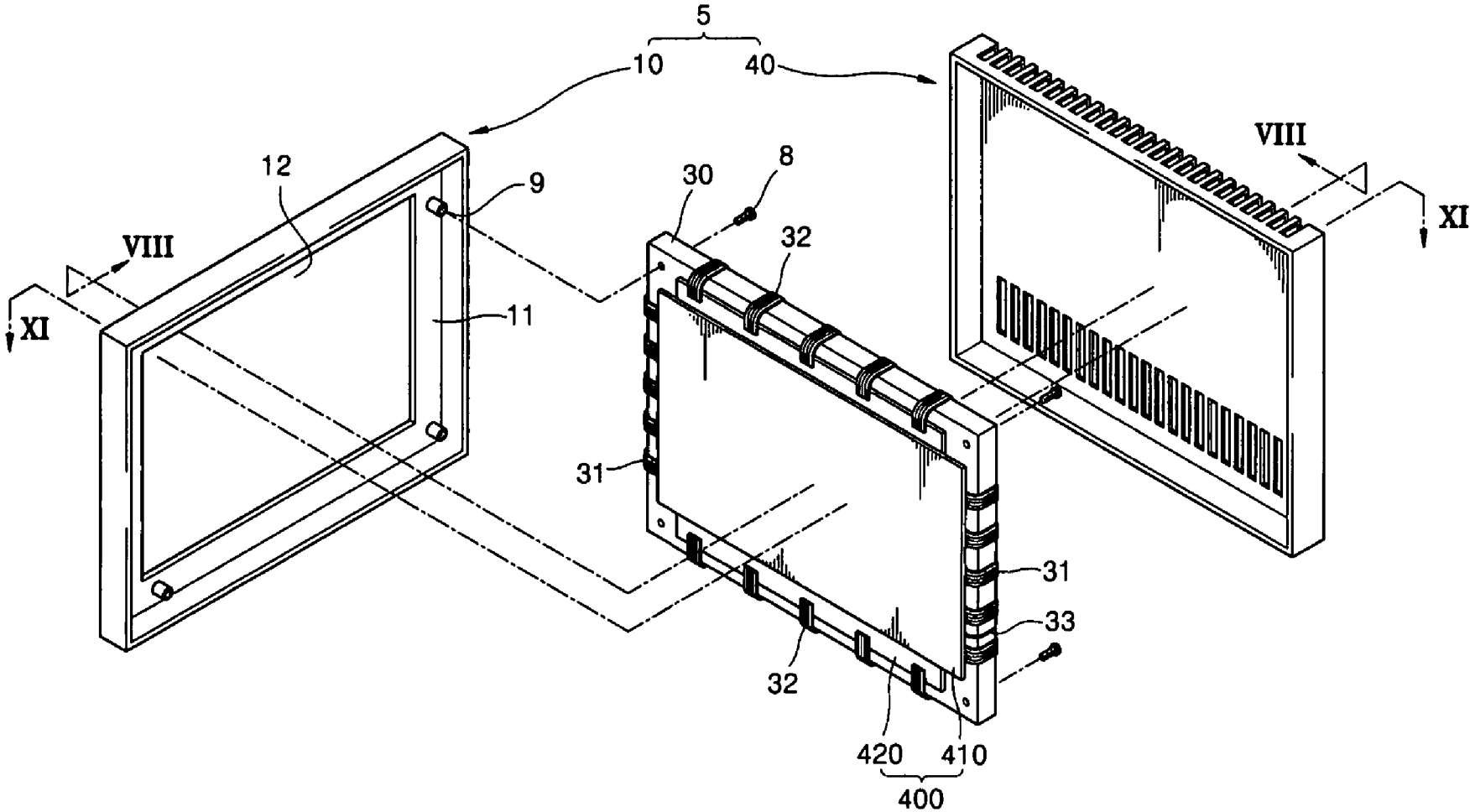
FIG. 5 is an exploded perspective view of a PDP according to a first embodiment of the present invention.

Referring to FIG. 5, the plasma display device comprises a front case 10 which includes a window 12 and a peripheral unit 11, a PDP 400 which includes a front panel 410 and a rear panel 420 and is located on the rear of the front case 10, a chassis 30 that supports the PDP 400, connecting cables 31 and 32 that connect the PDP 400 to a circuit substrate (not shown) and are located on the rear of the chassis 30, a connecting boss 9 and a screw 8 which couple the chassis 30 to the front case 10, and a case 5 composed of a rear case 40 and the front case 10 as a single body, wherein the rear case 40 is located on the rear of the chassis 30 and is coupled to the front case 10.

Figure 8:
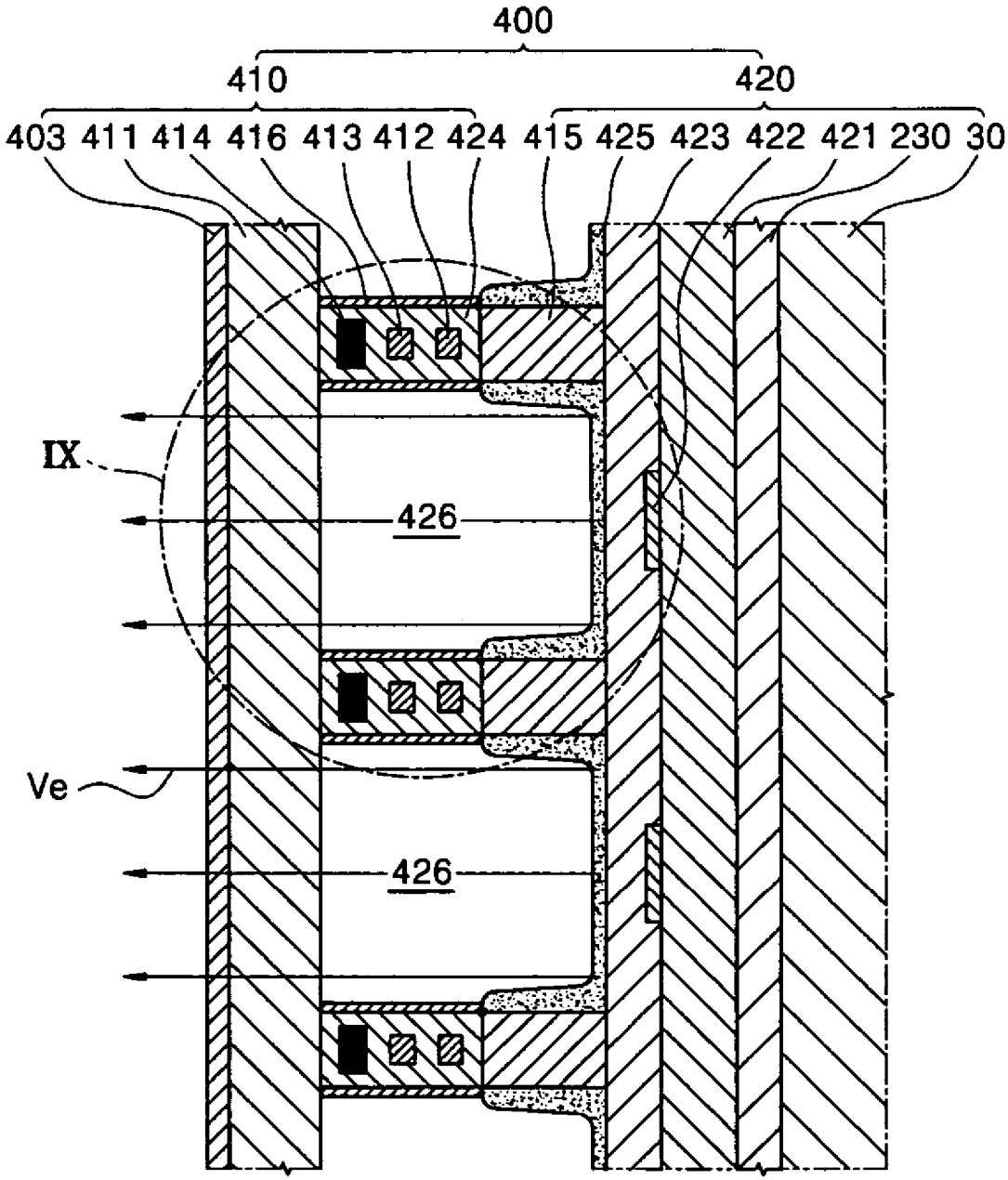
FIG. 8 is a cross-sectional view taken along line VIII—VIII of FIG. 5.

As depicted in FIG. 8, a thermal conductive sheet 230 is interposed between the PDP 400 and the chassis 30.

As is easily seen by comparing FIG. 1 and FIG. 5, a plasma display device having the PDP 400 according to a first embodiment of the present invention does not include an electromagnetic wave shielding filter 100 and a filter holder 20. This saves cost and time for manufacture and assembly. However, the PDP 400 according to the first embodiment of the present invention does include an element to shield electromagnetic waves generated during operation, which will be described later.

Now, the PDP 400 according to an embodiment of the present invention will be described in detail.

Figure 6:
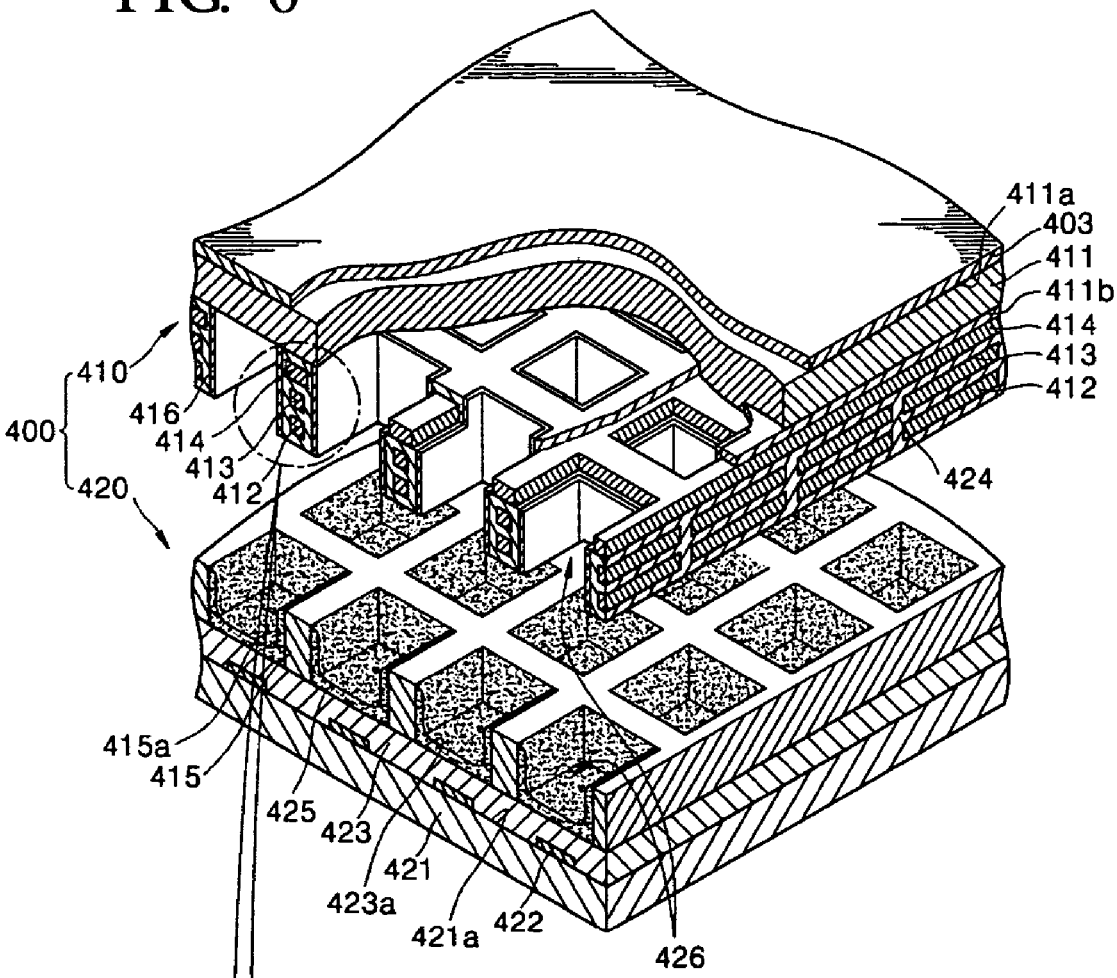
FIGS. 6 and 6A together form a cutaway exploded perspective view of a PDP according to a first embodiment of the present invention.

Referring to FIG. 6, the PDP 400 according to the first embodiment of the present invention comprises a front panel 410 and a rear panel 420. The front panel 410 includes a transparent front substrate 411 and the rear panel 420 includes a rear substrate 421 parallel to the front substrate 411.

The front panel 410 comprises: front barrier ribs 424 formed of dielectric, located on the rear surface of the front substrate 411, to define discharge cells 426 together with the front substrate 411 and the rear substrate 421; front discharge electrode 413 and rear discharge electrode 412 separated from each other and located in the front barrier rib 424 to surround the discharge cell 426; an electromagnetic wave shielding electrode 414 located between the front substrate 411 and the front discharge electrode 413 in the front barrier ribs 424, and separated from the front discharge electrode 413; a protective film 416 to cover a side surface 424*f*, which can be formed as necessary, of the front barrier ribs 424; and a near infrared ray shielding layer 403 formed on the front surface 411*a* of the front substrate 411.

The rear panel 420 comprises a rear substrate 421; address electrodes 422 on the front surface 421*a* of the rear substrate 421, crossing the front discharge electrodes and the rear discharge electrodes, and extending over the discharge cells 426 aligned in a row; a dielectric layer 423 to cover the address electrodes 422; rear barrier ribs 415 formed on the dielectric layer 423; and fluorescent layer 425 arranged in a space defined by the rear barrier rib 415.

The front panel 410 and the rear panel 420 are sealed by a coupling member such as frit (not shown), and the inside of the discharge cells 426 is filled with a discharge gas selected from the group consisting of Ne, He, and Ar or a mixture of those gases. The discharge gas can include approximately 10% Xe.

The front substrate 411 and the rear substrate 421 are generally formed of glass, and the front substrate 411 is preferably formed of a material having a high light transmission. The rear surface 411*b* of the front substrate 411 that defines the discharge cells 426 does not include the sustaining electrode pairs 214, the front dielectric layer 215 covering the sustaining electrode pairs 214, the protection film 216 covering the front dielectric layer 215, and the electromagnetic wave shielding filter 100 which has a light transmission of approximately 40–50%. Therefore, unlike the conventional alternate type three electrode surface discharge PDP, the front visible light transmission is significantly increased, since the visible light emitted from the fluorescent layers 425 of the discharge cells 426 passes through only the front substrate 411, which has high light transmission, and the near infrared shielding layer 403.

Also, in order to increase the brightness of the PDP 400, a reflection layer (not shown) can be formed on the upper surface 421 a of the rear substrate 421 or the upper surface 423*a* of the dielectric layer 423, or a light reflecting material can be included in the dielectric layer 423, to reflect visible light generated by the fluorescent layers 425 forward.

In an alternate type three electrode surface discharge PDP, the front discharge electrodes 413 and the rear discharge electrodes 412 are ITO electrodes, which have a relatively high resistance, to increase light transmission. However, in the present embodiment, the material for forming the front discharge electrodes 413 and the rear discharge electrodes 412 can be formed of materials having high electrical conductivity like Ag, Cu, Cr, or a composite of these materials without needing to consider the light transmission.

The front barrier ribs 424 are formed of dielectric and protect the front discharge electrodes 413, the rear discharge electrodes 412, and the electromagnetic wave shielding electrode 414 from damage by charged particles during discharge. The front barrier ribs 424, formed of a dielectric; also prevent direct electrical connection between the front discharge electrodes 413, the rear discharge electrodes 412, and the electromagnetic wave shielding electrode 414. The dielectric also generates a wall charge by inducing charged particles during discharge, and the wall charge helps the discharge between the front discharge electrodes 413 and the rear discharge electrodes 412. Dielectrics that can perform above function can comprise PbO, $B_2O_3$, or $SiO_2$.

The front barrier ribs 424 are formed to define the discharge cells 426 together with the front substrate 411 and the rear substrate 421 on the rear surface of the front substrate 411. In FIG. 6, the front barrier ribs 424 are depicted to define the discharge cells 426 as a matrix shape, but are not limited thereto and can be formed in a honeycomb shape or a delta shape. Also, in FIG. 6, the cross-section of the discharge cells 426 is rectangular, but is not limited thereto and can be shaped in a triangle, a polygon such as a pentagon, a circle, or an oval.

The front discharge electrode 413, the rear discharge electrode 412, and the electromagnetic wave shielding electrode 414 that surround the discharge cell 426 are disposed in the front barrier rib 424. Also, referring to the magnified portion in FIG. 6, to locate the front discharge electrodes 413, the rear discharge electrodes 412, and the electromagnetic wave shielding electrode 414 in the front barrier ribs 424, a first front barrier rib layer 424*a* is formed on the rear surface 411*b* of the front substrate 411 and the electromagnetic wave shielding electrode 414 is formed on the first front barrier rib layer 424*a*. A second front barrier rib layer 424*b* is formed on the electromagnetic wave shielding electrode 414 to cover the electromagnetic wave shielding electrode 414, and the front discharge electrodes 413 are formed on the second front barrier rib layer 424*b*. Afterward, a third front barrier rib layer 424*c* is formed on the front discharge electrodes 413 to cover the front discharge electrodes 413, and the rear discharge electrodes 412 are formed on the third front barrier rib layer 424*c*. A fourth front barrier rib layer 424*d* is formed on the rear discharge electrodes 412 to cover the rear discharge electrodes 412. Each of the first through the fourth front barrier rib layers 424*a* through 424*d* can be formed in more than two layers if necessary (for example, to make a thick layer).

Figure 6A:
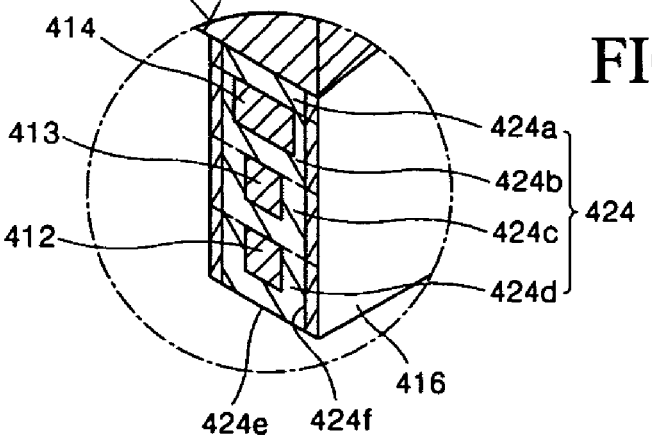

As depicted in FIGS. 6 and 6A, at least a portion of the side surface 424*f* of the front barrier ribs 424 is preferably covered by the protective film 416, and the protective film 416 is preferably formed of MgO. The protective film 416 protects the front discharge electrodes 413, the rear discharge electrodes 412, the electromagnetic wave shielding electrode 414, and the front barrier ribs 424, and also aids discharge through effective emission of secondary electrons. Referring to the magnified drawing of the front barrier ribs 424 in FIGS. 6 and 6A, the protective film 416 can be formed by deposition, and the protective film 416 can also be formed on the rear surface 424*e* of the front barrier ribs 424 and the rear surface 411*b* of the front substrate 411 during the deposition of the protective film 416. However, the protective film 416 formed on the rear surface 424*e* of the front barrier ribs 424 and the rear surface 411*b* of the front substrate 411 does not adversely affect the performance of the PDP of the present embodiment.

The rear barrier ribs 415 can be formed on the dielectric layer 423, and can be formed of glass containing elements such as Pb, B, Si, Al and O, and when necessary, a filler such as $ZrO_2$, $TiO_2$, and $Al_2O_3$ and a pigment such as Cr, Cu, Co, Fe, and $TiO_2$. The rear barrier ribs 415 can be formed of the same material as the front barrier ribs 424.

The rear barrier ribs 415 secure a space for locating the fluorescent layer 425, define the discharge cells 426, and prevent cross talk between discharge cells. Also, together with the front barrier ribs 424, they resist the negative pressure generated by the vacuum (for example, 0.5 atm) of a discharge gas filling the space between the front panel 410 and the rear panel 420. The rear barrier ribs 415 can include a reflection material so that the visible light generated by the discharge cell can be reflected forward. The fluorescent layers 425 of red, green and blue can be located in the space defined by the rear barrier ribs 415, and the fluorescent layers 425 are sectioned by the rear barrier ribs 415.

The fluorescent layer 425 is formed by drying and sintering a fluorescent paste applied on the front surface 423*a* of the dielectric layer 423 and the side surface 415*a* of the rear barrier ribs 415, and is a mixture of solvent, a binder, and a red, green, or blue light emitting fluorescent material. The red light emitting fluorescent material can be a material such as Y(V,P)O4:Eu, the green light emitting fluorescent material can be materials such as ZnSi04:Mn, YBO3:Tb, and the blue light emitting fluorescent material can be a material such as BAM:Eu.

Figures 7, 7A:
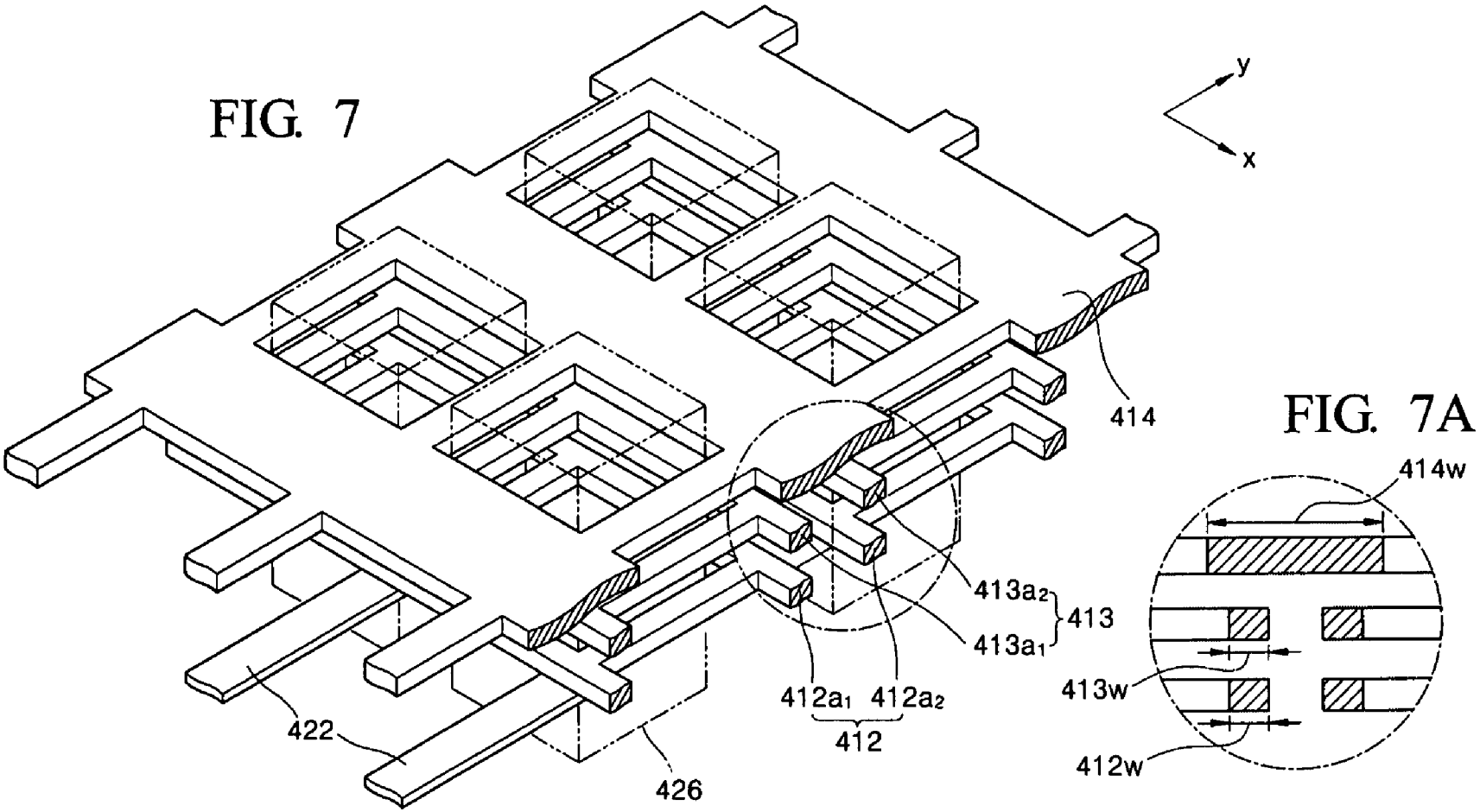
FIGS. 7 and 7A is a cutaway perspective view and a magnified portion thereof of a discharge cell, an electromagnetic wave shielding electrode, front discharge electrodes, and rear discharge electrodes of the PDP according to a first embodiment of the present invention.

In FIGS. 7 and 7A, the front discharge electrodes 413, the rear discharge electrodes 412, the electromagnetic wave shielding electrode 414, and the discharge cells 426 according to the first embodiment are depicted. In FIGS. 7 and 7A, the front discharge electrodes 413 and the rear discharge electrodes 412 extend along the x axis parallel to each other, and the address electrodes 422 extend along the y axis to cross the front discharge electrodes 413 and the rear discharge electrodes 412 in the discharge cells 426.

On the other hand, it is preferable that the addressing discharge occurs between the rear discharge electrode 412 and the address electrode since the distance between the rear discharge electrode and the address electrode is shorter than the distance between the front discharge electrode and the address electrode. The rear discharge electrode 412 is preferably a common electrode and the front discharge electrode 413 is preferably a scan electrode, but the present invention is not limited thereto.

The electromagnetic wave shielding electrode 414 is located in front of the front discharge electrodes 413, and it is not necessarily located in the front barrier ribs 424 as depicted in FIG. 6. The locations of the electromagnetic wave shielding electrode 414 will be described later.

The width 414*w* of the electromagnetic wave shielding electrode 414 is preferably greater than the widths 413*w* and 412*w* of the front discharge electrodes 413 and the rear discharge electrodes 412. In this manner, the electromagnetic waves generated at the front discharge electrodes 413 and the rear discharge electrodes 412 can be shielded readily. However, the width 414*w* of the electromagnetic wave shielding electrode 414 is not necessarily greater than the widths 413*w* and 412*w* of the front discharge electrodes 413 and the rear discharge electrodes 412, while still shielding the electromagnetic waves within the permissible electromagnetic wave generation range. Also, the width 414*w* of the electromagnetic wave shielding electrode 414 is preferably large enough to simultaneously cover the front discharge electrodes 413*a*1 and 413*a*2 located sequentially along a row of the discharge cells 426 and adjacent to each other in the front barrier ribs 424, and to cover the rear discharge electrodes 412*a*1 and 412*a*2 extending sequentially parallel to the front discharge electrodes 413 and adjacent to each other in the front barrier ribs 424 from the front surface of the front discharge electrodes 413 and the rear discharge electrodes 412, but the present invention is not limited thereto.

Also, the electromagnetic wave shielding electrode 414 can be formed separately along the light emitting cells of the x axis as the front discharge electrodes 413 and the rear discharge electrodes 412 depicted in FIG. 7 However, in this case also, an additional electrical conductor to the electromagnetic wave shielding electrode 414 or a plurality of grounding conductors is required for migration of free electrons in the electromagnetic wave shielding electrode 414. The concept of the present invention includes one or more electromagnetic wave shielding electrodes 414 in front of the front discharge electrodes 413, in order to perform the electromagnetic wave shielding function. Generation of the electromagnetic waves, migration of the free electrons, and the grounding in relation to the electromagnetic wave shielding electrode 414 will be described later.

The operation of the PDP 400 having above structure will now be described. The operation of the PDP 400 described herewith is only illustrative, and therefore the present invention is not limited thereto.

When applying an address voltage between the address electrodes 422 and the rear discharge electrodes 412 from an external power source, a discharge cell 426 to be illuminated is selected, and then wall charges accumulate on the side surface of the barrier rib where the rear discharge electrodes 412 of the selected discharge cells 426 are located. Afterward, when a high voltage pulse is applied to the front discharge electrodes 413 and a relatively low voltage pulse (generally it can be a ground voltage, but is not limited thereto) is applied to the rear discharge electrodes 412, the wall charges migrate due to the potential voltage difference generated between the front discharge electrodes 413 and the rear discharge electrodes 412. A plasma is generated by the collision of the migrating wall charges with atoms of the discharge gas in the discharge cells. A discharge is easily initiated at points where the front discharge electrodes 413 and the rear discharge electrodes 412 are close to each other, since a relatively strong electric field is formed at these points. Unlike the alternate type three electrode surface discharge PDP 200 in which the discharge occurs mainly on the rear of the front dielectric layer 215, that is, on the rear surface 216*a* of the protective film 216, in the case of the present embodiment, the amount of the discharge is significantly increased since the discharge occurs in the surrounded side surface of the discharge cells 426 where the front discharge electrode 413 and the rear discharge electrodes 412 are located. Also, when the voltage between the front discharge electrodes 413 and the rear discharge electrodes 412 is maintained for a defined period of time, the electric fields formed on the side surfaces of the discharge cells 426 are concentrated on the center of the discharge cells 426. Accordingly, the discharge region is greater than that of the previously described PDP, and accordingly, the amount of ultraviolet radiation generated by the discharge is increased. Also, ion sputtering to the fluorescent layers 425 is prevented, since the discharge occurs from the surrounding area toward the center of the discharge cells 426, blocking the migration of ions colliding with the fluorescent layers 425.

When the voltage difference between the front discharge electrodes 413 and the rear discharge electrodes 412 after discharging is lower than the discharge voltage, no further discharge occurs, but a space charge and a wall charge are formed in the discharge cells 426. When applying an opposite voltage to the pulse voltage initially applied to the front discharge electrodes 413 and the rear discharge electrodes 412, a discharge occurs again by reaching the firing voltage with the aid of the wall charge. By applying the pulse voltage alternately to the front discharge electrodes 413 and the rear discharge electrodes 412, the discharge is continued. Ultraviolet rays generated by the discharge excite fluorescent molecules of the fluorescent layers 425 by colliding with the fluorescent layers 425. When the excited fluorescent molecules fall from a higher energy level to a lower energy level, visible light is generated. Some of the visible light proceeds forward and the rest displays an image after reflecting from the dielectric layer 423, the rear barrier ribs 415, or the rear substrate 421. A predetermined color image can be displayed when the red, green, or blue light fluorescent material is coated in each discharge cell of the unit pixels that form a color image.

The principle of generating an electromagnetic wave and the function of the electromagnetic wave shielding electrode 414 will now be described with reference to FIG. 7.

As described above, a pulse voltage that can cause a discharge, the magnitude and polarity of which can change according to time, is applied between the front discharge electrodes 413 and the rear discharge electrodes 412. The magnitude and direction of the electric field generated by the front discharge electrodes 413 and the rear discharge electrodes 412 can also change according to time, with changes in the pulse voltage. Also, when the magnitude and direction of the electric field change according to time, as can be verified by Maxwell's equations, an magnetic field is induced. The magnetic field also changes according to time since the rate of change of the electromagnetic field is not constant. When the electromagnetic waves are irradiated by the PDP, they can cause malfunctions of other electronic devices, and are also harmful to the human body. When an electromagnetic wave shielding electrode 414 formed of a conductive material is located in front of the front discharge electrodes 413, the electromagnetic waves generated between the front discharge electrodes 413 and the rear discharge electrodes 412 move free charges in the electromagnetic wave shielding electrode 414. This reduces the electromagnetic waves as their energy is consumed in moving the free charges. In addition, electromagnetic waves generated by the circuit unit, which controls, transforms, and amplifies the voltages applied to the PDP, located on the rear of the chassis, can also be shielded by the electromagnetic wave shielding electrode 414 by the same principle as described above.

The contribution of the electromagnetic wave shielding electrode 414 to the increase in light transmission and heat radiation characteristics will now be described with reference to FIG. 8.

As seen in FIG. 4, the transmission of visible light in the PDP 200 is significantly reduced by the conductive mesh layer 111 which blocks a portion of the visible light emitted from the discharge cells 226, since the electromagnetic wave shielding filter 100 having the conductive mesh layer 111 is located in front of the PDP 200.

However, in the PDP 400 of the present embodiment, the electromagnetic wave shielding electrode 414 can act as the electromagnetic wave shielding filter 100 without blocking the visible light from the fluorescent layers 425 since the electromagnetic wave shielding electrode 414 is formed in the front barrier ribs 424 together with the front discharge electrodes 413 and the rear discharge electrodes 412.

Also, unlike the PDP 200, since the PDP 400 according to the present embodiment does not have a space formed by the electromagnetic wave shielding filter 100 and the filter holder 20, heat generated by the PDP 400 is not trapped but is instead easily released to the outside. Also, the electromagnetic wave shielding electrode 414 can dissipate heat generated by the PDP 400 since the electromagnetic wave shielding electrode 414 generally has a high thermal conductivity and is grounded to a relatively low temperature conductive member outside the PDP 400. The grounding of the electromagnetic wave shielding electrode 414 will be described later.

Figure 9:
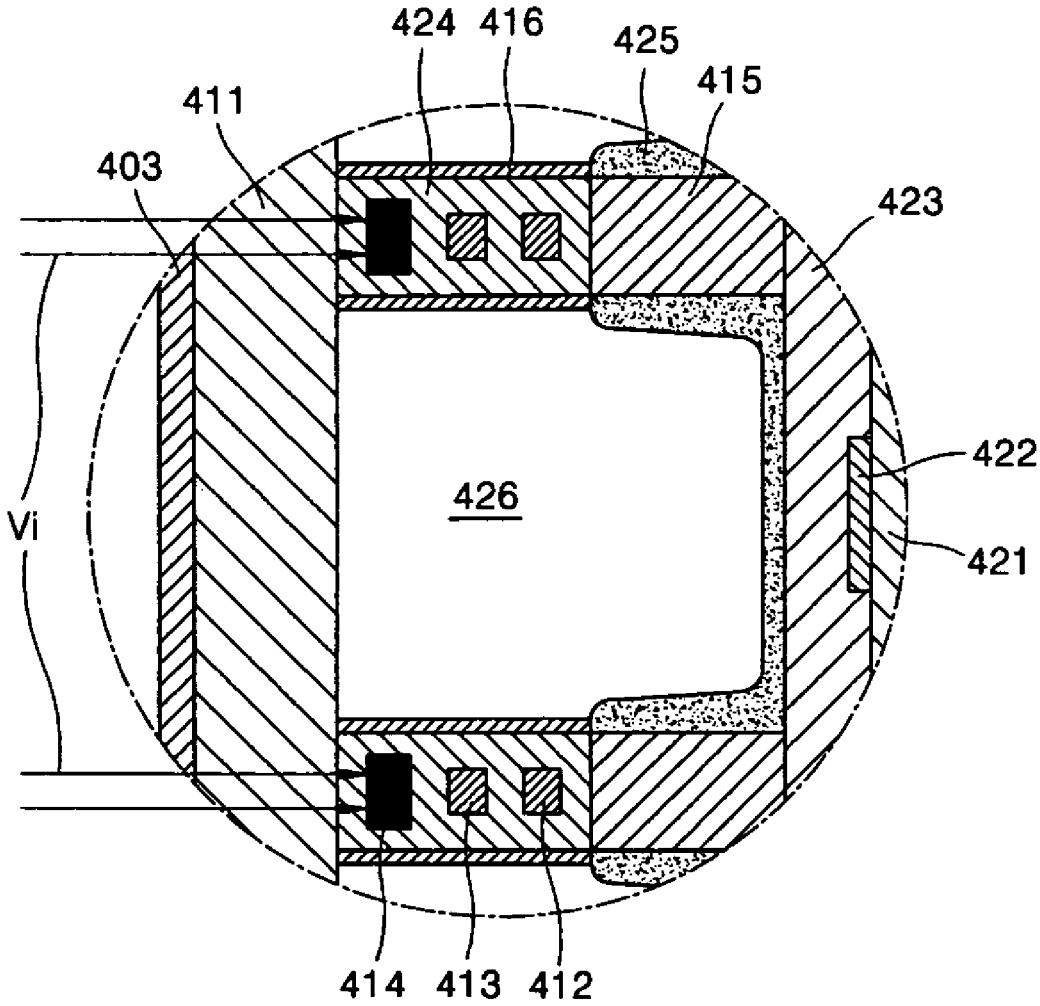
FIG. 9 is a magnified drawing of FIG. 8 showing an external light absorption effect of the electromagnetic wave shielding electrode.

The contribution of the electromagnetic wave shielding electrode 414 to the improvement of contrast ratio will now be described with reference to FIG. 9. The PDP 200 has a low contrast ratio since external light Vi from an external light source enters the PDP 200 and can not be efficiently absorbed but is reflected forward. However, in the first embodiment of the present invention, the reduction of contrast ratio by light reflection can be prevented by making the electromagnetic wave shielding electrode 414 a dark color to easily absorb external light Vi and prevent reflection.

Figure 10:
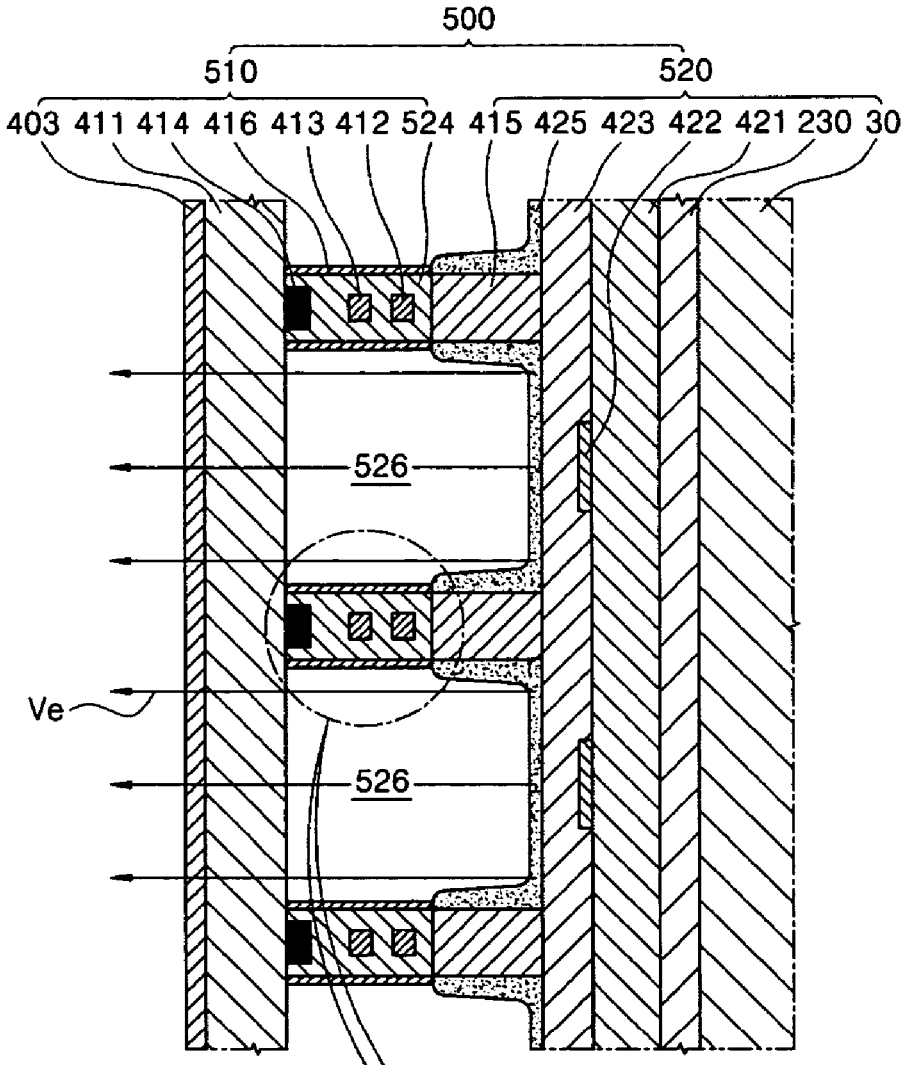
FIGS. 10 and 10A together form a cross-sectional view of a PDP according to a first modified version of the first embodiment of the present invention.
Figure 10A:
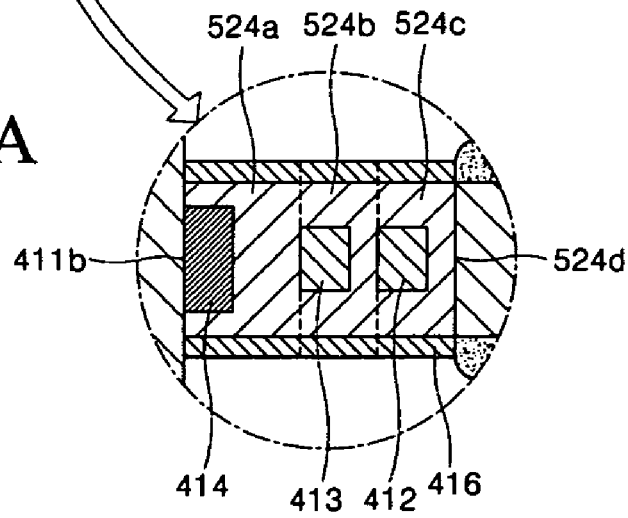

A modified version of PDP from the first embodiment of the present invention will now be described, focusing on the features which differ from the first embodiment, with reference to FIG. 10. In the modified version of PDP 500, the electromagnetic wave shielding electrode 414 is not located in front barrier ribs 524 but on the rear surface 411*b* of the front substrate 411, covered by front barrier ribs 524. As can be seen in the magnified drawing of the front barrier ribs 524 in FIG. 10, the front barrier ribs 524 include the electromagnetic wave shielding electrode 414 on the rear surface 411*b* of the front substrate 411, a first front barrier rib layer 524*a* formed on a rear surface of the front substrate 411 to cover the electromagnetic wave shielding electrode 414, and the front discharge electrodes 413 on the first front barrier rib layer 524*a*. A second front barrier rib layer 524*b* is formed on the front discharge electrodes 413 to cover the front discharge electrode 413, and the rear discharge electrode 412 is formed on the second front barrier rib layer 524*b*. Afterward, a third front barrier rib layer 524*c* is formed on the rear discharge electrodes 412 to cover the rear discharge electrodes 412.

In the modified version of the first embodiment of the present invention, as can be seen from the process for forming the front barrier rib 524, the process for forming the fourth front barrier rib layer 524*d* is omitted, thereby reducing processing and manufacturing costs. Each of the first through third front barrier rib layers 524*a*, 524*b*, and 524*c* can include more than two layers (for example, to make a thick layer) as necessary.

The electromagnetic wave shielding electrode 414 can be formed in a variety of locations beside that of the modified version of the present invention. For example, after forming a hollow portion (not shown) on a location where the front barrier rib of the rear surface of the front substrate is formed, and an electromagnetic wave shielding electrode is formed in the hollow portion, the front barrier rib can be formed on the electromagnetic wave shielding electrode. Also, after forming the electromagnetic wave shielding electrode 414 on the front surface of the front substrate, the electromagnetic wave shielding electrode 414 can be covered by a planarizing material having good light transmission. Also, after forming the electromagnetic wave shielding electrode 414 on the front surface of the front substrate, the electromagnetic wave shielding electrode 414 can be covered by the near infrared ray shielding layer 403. Also, after forming the electromagnetic wave shielding electrode 414 on the front surface of the near infrared ray shielding layer 403, the electromagnetic wave shielding electrode 414 can be covered by an additional planarizing layer. After forming the electromagnetic wave shielding electrode 414 on the front surface of the front substrate 411, the electromagnetic wave shielding electrode 414 can be covered by an optical film such as a light reflection film as well as the near infrared ray shielding layer. Also, after forming the electromagnetic wave shielding electrode 414 on the front surface of the optical film, the electromagnetic wave shielding electrode 414 can be covered by a planarizing layer. Accordingly, the location of the electromagnetic wave shielding electrode 414 is not limited to the embodiment of the present invention.

Figure 11:
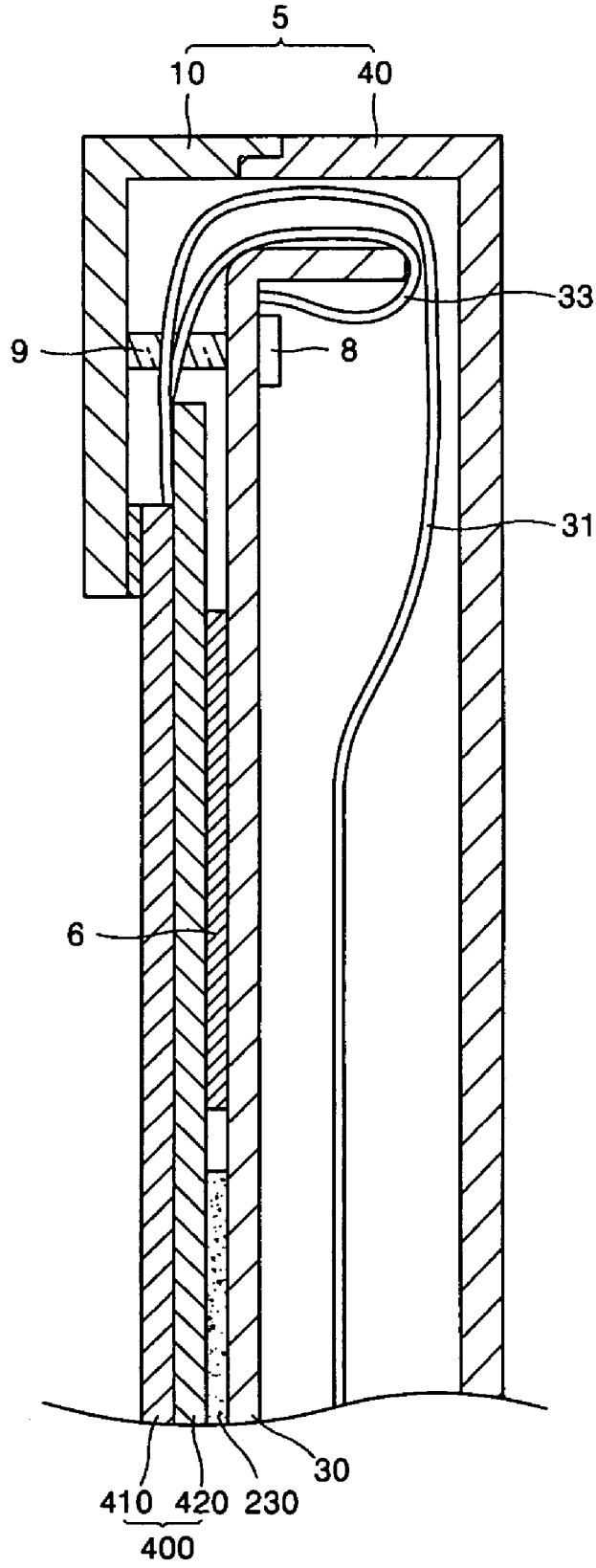
FIG. 11 is a cross-sectional view taken along line XI—XI of FIG. 5.

Grounding of the electromagnetic wave shielding electrode 414 according to the present invention will now be described with reference to FIG. 11. A grounding conductor for migration of free charges from the PDP 400 to the outside is preferably included in the PDP 400 since the electromagnetic wave shielding electrode 414 shields the electromagnetic waves generated at the PDP 400 by the movement of the free charges. In this reason, the electromagnetic wave shielding electrode 414 needs to be grounded by electrically connecting a conductive grounding cable 33 to the electromagnetic wave shielding electrode 414 in the PDP 400, and connecting the grounding cable 33 to the chassis 30 formed of a conductive member and located outside of the PDP 400.

However, connecting the grounding cable 33 to a conductive member is not limited to the chassis 30. That is, for grounding the electromagnetic wave shielding, the grounding cable 33 can be electrically connected to the case 5 outside of the PDP 400, or to a grounding unit (not shown) of the circuit unit to the rear of the chassis 30. Also, the electromagnetic wave shielding electrode 414 can be grounded by electrically connecting the grounding cable 33 to the conductive connecting boss 9 and a screw 8 which couple the chassis 30 to the front cabinet 10. The conductive member is not limited to the above description, and grounding can be achieved by connecting the grounding cable 33 to any conductive member outside the PDP 400.

A second embodiment of the present invention will now be described, focusing on the features which differ from the first embodiment, with reference to FIGS. 12 and 13.

Figure 13:
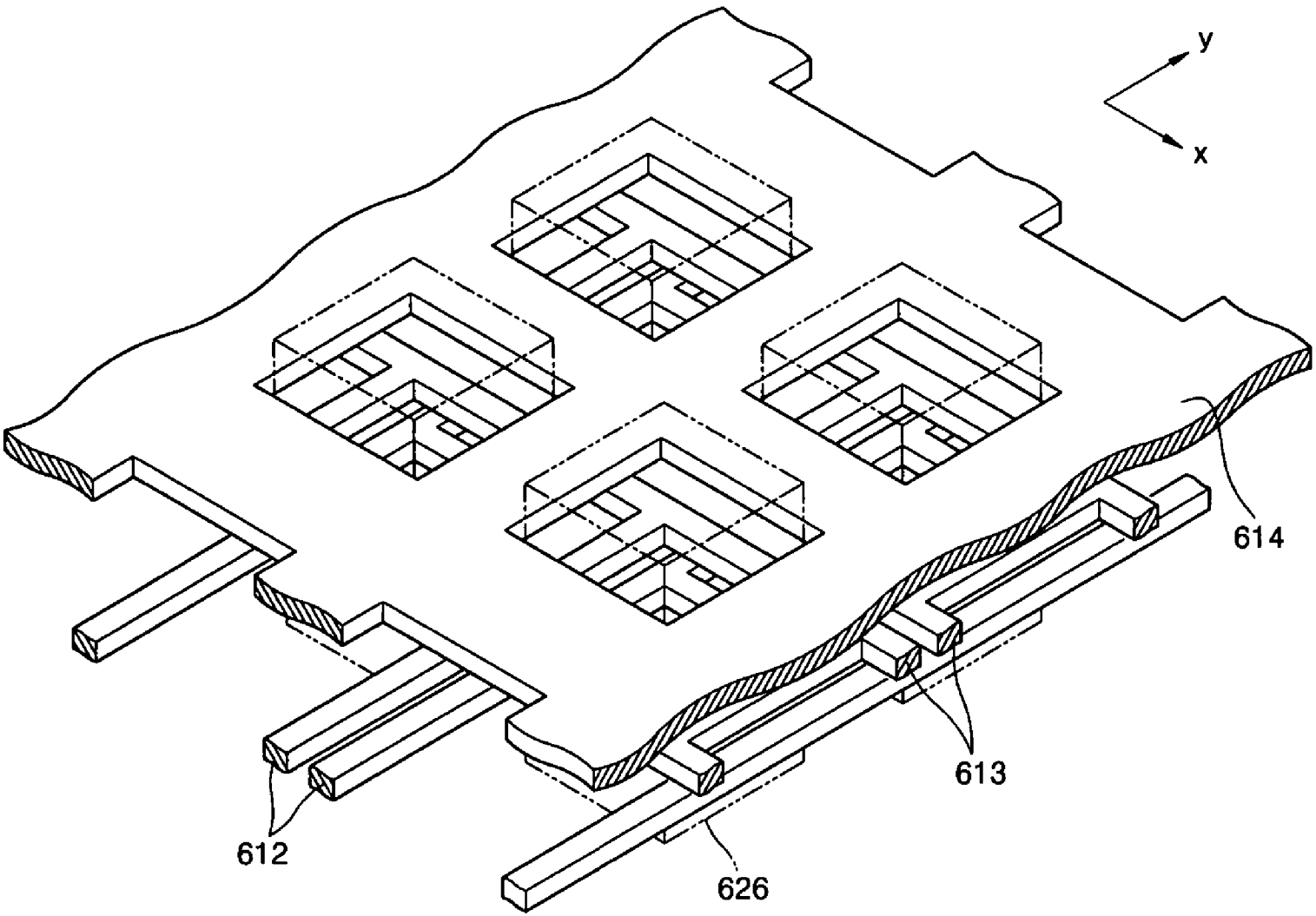
FIG. 13 is a cutaway perspective view of a discharge cell, an electromagnetic wave shielding electrode, front discharge electrodes, and rear discharge electrodes of the plasma display panel according to a second embodiment of the present invention.

In the second embodiment, the address electrodes of the first embodiment do not exist, but instead, as can be seen in FIG. 13, front discharge electrodes 613 extend along the x axis and rear discharge electrodes 612 extend along the y axis to cross the front discharge electrodes 613 at discharge cells 626.

The operation of a PDP 600 according to the second embodiment will now be described, focusing on the differences from the first embodiment. In the second embodiment, unlike the first embodiment, addressing discharge occurs when a voltage is applied to the front discharge electrodes 613 and the rear discharge electrodes 612, and a wall charge accumulates on the side surface of the discharge cells 626. That is, the addressing discharge which occurred between the address electrodes and the rear discharge electrodes in the first embodiment, occurs between the front discharge electrodes 613 and the rear discharge electrodes 612. Therefore, the discharge cell 626 to be discharged is selected and then the sustaining discharge occurs in the discharge cell 626. So, the PDP 600 can display an image in this process.

Referring to FIG. 14, a third embodiment will now be described, focusing on the features which differ from the first embodiment. The PDP 700 of the third embodiment has a single combined barrier rib 724 instead of the front barrier rib 424 and the rear barrier rib 415 of the PDP 400 in the first embodiment. The combining the front barrier rib 424 and the rear barrier rib 415 to a single unit does not imply that the barrier rib 724 is formed by a single process, but rather that the front barrier rib 424 and the rear barrier rib 415 can not be separated without breaking since they are bonded by an adhesive. To manufacture the single combined barrier rib 724, referring to the magnified drawing in FIG. 14, a rear barrier unit 724*b* of the barrier rib 724 is formed on the front surface 421 a of the rear substrate 421. After arranging a paste that contains fluorescent material in a space defined by the rear barrier rib unit 724*b*, the paste is dried and sintered.

Afterward, a first barrier rib layer 724*c* is formed on the rear barrier rib unit 742*b* of the barrier rib 724, the rear discharge electrode 412 is formed on the first barrier rib layer 724*c*, a second barrier rib layer 724*d* is formed to cover the rear discharge electrode 412, the front discharge electrode 413 is formed on the second barrier rib layer 724*d*, and a third barrier rib layer 724*e* is formed to cover the front discharge electrode 413. Then, the electromagnetic wave shielding electrode 414 is formed on the third barrier rib layer 724*e*, and the electromagnetic wave shielding electrode 414 is covered by a fourth barrier rib layer 724*f*. Each of the rear unit 742*b* of the barrier rib 724 and the first through fourth barrier rib layers 724*c*, 724*d*, 724*e*, and 724*f* can include more than two layers (for example, to make a thick layer) as necessary.

After forming the barrier rib 724 by the above method, the protective film 416 is formed on a front unit 724*a* of the barrier rib 724 on which at least the electromagnetic wave shielding electrode 414, the front discharge electrode 413, and the rear discharge electrode 412 are formed. The protective film 416 can also be formed on the upper surface 425*a* of the fluorescent layer 425 and the front surface 724*g* of the barrier rib 724. However, forming the protective film 416 on the upper surface 425*a* of the fluorescent layer 425 and the front surface 724*g* of the barrier rib 724 does not adversely affect the operation of the PDP 700. On the contrary, the protective film 416 on the upper surface 425*a* of the fluorescent layer can increase the emission of secondary electrons when discharging and prevent degradation of the fluorescent layer.

On the other hand, from the above descriptions, it is clear that the barrier ribs of the first embodiment, the modified version of the first embodiment, the second embodiment, and the third embodiment of the present invention can be formed in a single unit.

The present invention provides the following advantages.

First, the PDP according to the present invention employs a structure where discharge electrodes are formed in the barrier ribs surrounding the discharge cells, unlike a conventional PDP in which the sustaining electrode pairs are formed on the front panel of the PDP. This structure needs no dielectric layer or protective film on the front panel of the PDP through which visible light is transmitted. Also, no electromagnetic wave shielding filter is needed in front of the PDP, since an electromagnetic wave shielding electrode is located in front of the front discharge electrode. Accordingly, the PDP according to the present invention has improved light transmission, since the visible light emitted from the fluorescent layers in the discharge cells only passes through the front substrate and a near infrared absorbing layer, and not through the omitted layers which all have bad light transmission.

Second, in a conventional PDP, the majority of the sustaining electrode pairs (except the bus electrodes) have to be formed of ITO, which has a high resistance, to allow visible light from the florescent layers in the discharge cells to pass, since the sustaining electrode pairs that cause discharge are located on the rear surface of the front substrate. Therefore, there are problems of increased operating voltage and non-uniform images on a large panel, due to the voltage drop of the ITO electrodes. However, in the present invention, the discharge electrodes can be formed of a material having high electrical conductivity, since the discharge electrodes are located in the barrier ribs, thereby solving above problems.

Third, a conventional PDP has low light emitting efficiency since discharge initiates on the rear of the protective film and diffuses in the discharge cells since the sustaining electrode pairs that cause discharge are located on the rear surface of the front substrate. Also, there is the problem of a permanent latent image due to ion sputtering of charged particles of a discharge gas by an electric field after long use. However, the present invention solves the ion sputtering problem, since the discharge initiates from the entire side surfaces that surround the discharge cells and diffuses toward the center.

Fourth, a conventional PDP is expensive and time consuming to manufacture, since the electromagnetic wave shielding filter and the filter holder have to be coupled to the front case after manufacturing them separately. However, in the present invention, the function of the electromagnetic wave shielding filter is replaced by the electromagnetic wave shielding electrode, removing the need for the electromagnetic wave shielding filter and the filter holder, and that the electromagnetic wave shielding electrode is formed integral with the PDP, thereby reducing manufacturing cost.

Fifth, the present invention solves the problem of dissipating heat from the space formed by the thickness of the filter holder between the electromagnetic wave shielding filter and the conventional PDP, thereby increasing the heat radiation efficiency of the PDP.

Sixth, the dark colored electromagnetic wave shielding electrode absorbs external light without reflecting it, thereby increasing the contrast ratio.

While the present invention has been particularly shown and described with reference to exemplary embodiments thereof, it will be understood by those of ordinary skill in the art that various modifications in form and details can be made therein without departing from the spirit and scope of the present invention as defined by the following claims.

What is claimed is:

1. A plasma display panel (PDP), comprising:

a front substrate;

a rear substrate arranged in parallel to the front substrate;

a plurality of front barrier ribs, consisting of a dielectric material, arranged between the front substrate and the rear substrate to define discharge cells together with the front substrate and the rear substrate;

a plurality of front discharge electrodes arranged within the front barrier ribs to surround at least part of the discharge cells;

a plurality of rear discharge electrodes arranged within the front barrier ribs to surround at least part of the discharge cells, the rear discharge electrodes being separated from the front discharge electrodes, at least one of the plurality of front discharge electrodes and the plurality of rear discharge electrodes includes a plurality of separate electrodes:

at least one electromagnetic wave shielding electrode, arranged in front of and separated from the front discharge electrodes, and surrounding at least part of the discharge cells;

a plurality of rear barrier ribs arranged between the front barrier ribs and the rear substrate;

a fluorescent layer arranged in each space defined by the rear barrier ribs; and a discharge gas arranged within the discharge cells.

2. The PDP of claim 1, wherein the at least one electromagnetic wave shielding electrode is arranged in the front barrier ribs.

3. The PDP of claim 1, wherein the at least one electromagnetic wave shielding electrode is arranged on the rear of the front substrate and covered by the front barrier ribs.

4. The PDP of claim 1, wherein the at least one electromagnetic wave shielding electrode is of a dark color.

5. The PDP of claim 1, wherein the at least one electromagnetic wave shielding electrode is electrically connected to an external conductive member of the PDP.

6. The PDP of claim 5, wherein the external conductive member comprises a chassis adapted to support the PDP from the rear of the PDP.

7. The PDP of claim 1, further comprising a near infrared ray shielding layer affixed to the front substrate.

8. The PDP of claim 1, wherein the plurality of front discharge electrodes extend in one direction and the plurality of rear discharge electrodes extend to cross the front discharge electrodes in the discharge cells.

9. The PDP of claim 1, further comprising address electrodes, wherein the plurality of front discharge electrodes and the plurality of rear discharge electrodes extend in one direction and wherein the address electrodes extend to cross the plurality of front discharge electrodes and the plurality of rear discharge electrodes.

10. The PDP of claim 9, wherein the address electrodes are arranged between the rear substrate and the fluorescent layers, and wherein a dielectric layer is located between the address electrodes and the fluorescent layers.

11. The PDP of claim 1, wherein the plurality of front discharge electrodes and the plurality of rear discharge electrodes each have a ladder shape, and at least the side surface of the front barrier ribs is covered by a protective film.

12. The PDP of claim 1, wherein the front barrier ribs and the rear barrier ribs comprise a single unit.

* * * * *